United States Patent [19]

Chang et al.

[11] Patent Number: 4,965,605

[45] Date of Patent: Oct. 23, 1990

[54] LIGHTWEIGHT, LOW PROFILE PHASED ARRAY ANTENNA WITH ELECTROMAGNETICALLY COUPLED INTEGRATED SUBARRAYS

[75] Inventors: Donald C. Chang, Thousand Oaks; Mon N. Wong, Torrance; Robert J. Patin, Hawthorne; Stanley S. Chang, Palos Verdes Estates, all of Calif.

[73] Assignee: HAC, Los Angeles, Calif.

[21] Appl. No.: 352,787

[22] Filed: May 16, 1989

[51] Int. Cl.[5] ..... H01Q 13/080; H01Q 1/320

[52] U.S. Cl. ..... 343/700 MS; 343/846

[58] Field of Search ..... 343/700 MS, 777, 778, 343/846, 829; 342/371, 372, 368

[56] References Cited

U.S. PATENT DOCUMENTS

| | | | |
|---|---|---|---|
| 4,257,050 | 3/1981 | Ploussios | 342/372 |
| 4,532,519 | 7/1985 | Rudish et al. | 342/372 |
| 4,639,732 | 1/1987 | Acoraci et al. | 342/371 |
| 4,761,654 | 8/1988 | Zaghloul | 343/700 MS |
| 4,816,835 | 3/1989 | Abiko et al. | 343/700 MS |
| 4,825,172 | 4/1989 | Thompson | 343/778 |
| 4,829,309 | 5/1989 | Tsukamoto et al. | 343/700 MS |
| 4,835,538 | 5/1989 | McKenna et al. | 343/700 MS |
| 4,882,555 | 11/1989 | Wong | 333/116 |

*Primary Examiner*—Rolf Hille
*Assistant Examiner*—Peter Toby Brown
*Attorney, Agent, or Firm*—Robert A. Westerlund; Steven M. Mitchell; Wanda K. Denson-Low

[57] ABSTRACT

A lightweight, low profile phased array antenna 10 is disclosed which includes an electromagnetically coupled integrated subarray in a multilayer structure with no vertical electrical connections and no phase shifters. The integrated subarray includes a first layer 11 having an array of patches 20 of electrically conductive material. A second layer 15, is provided, in parallel registration with the first layer 11, which includes an array of resonators 22, each resonator 22 being electromagnetically coupled to a corresponding patch 20 in the first layer 11. A third layer 19 is provided which is in parallel registration with the second layer 15. Electromagnetic couplers 24 and 34 in the second and third layers 15 and 19 couple energy received by resonators 22 in the second layer 15, to processing circuitry in the third layer 19. The antenna of the present invention is adapted for transmit and receive modes of operation.

15 Claims, 8 Drawing Sheets

11
20
20
20
20
15
22
22
24
24
20
20
19
34
44
44

FIG. 4
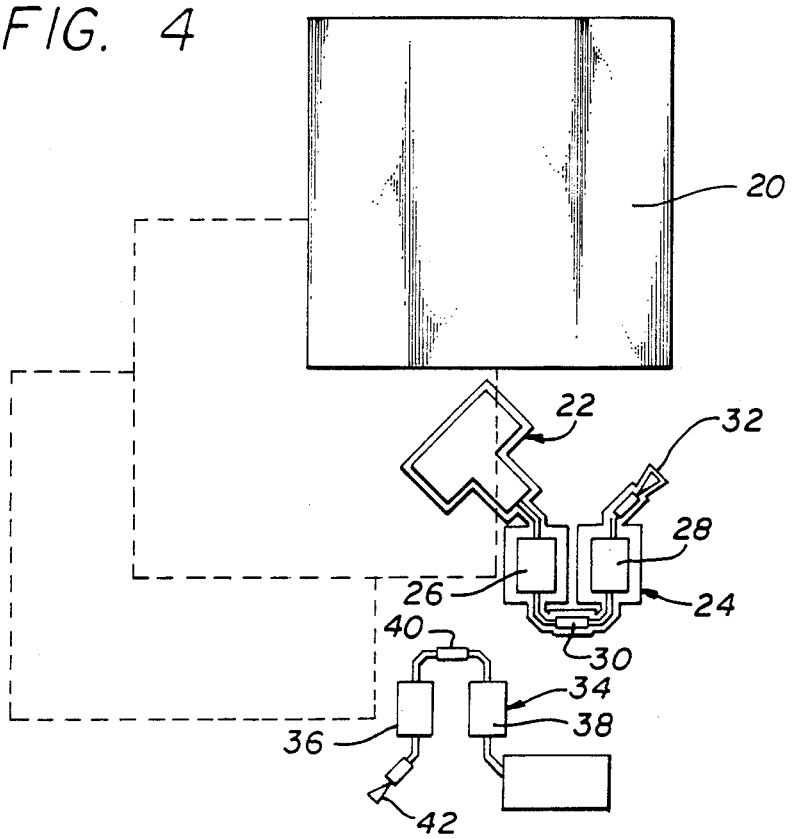
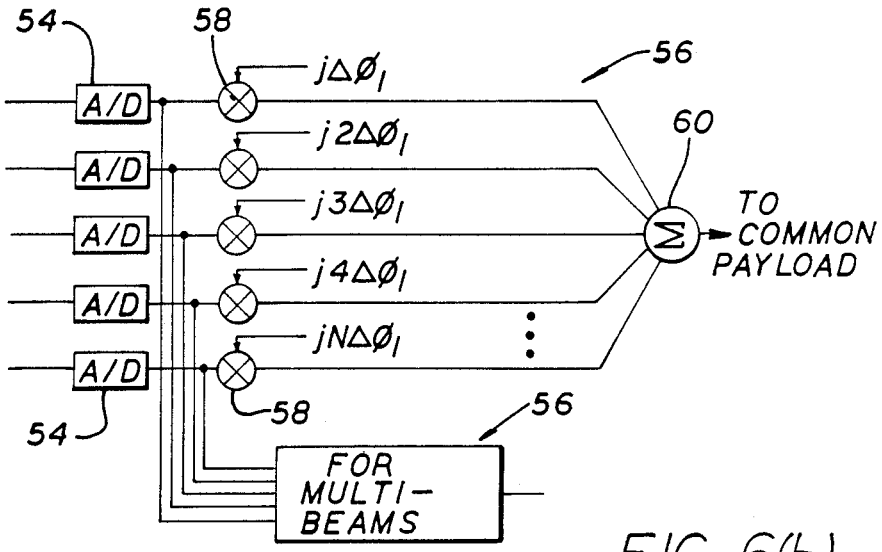
FIG. 6(b)

TO DBF
TO DBF
TO DBF BEAM
DIRECT VECTOR
54
54
A/D
A/D
52
52
DOWN CONV.
DOWN CONV.
48
SWITCH MATRIX
46
BUTLER MATRIX
44
44
20
20
CONTROLLER
50

LIGHTWEIGHT, LOW PROFILE PHASED ARRAY ANTENNA WITH ELECTROMAGNETICALLY COUPLED INTEGRATED SUBARRAYS

BACKGROUND OF THE INVENTION

1. Field of the Invention

The present invention relates to array antennas. More specifically, the present invention relates to compact, lightweight and low profile digital phased array antennas.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

As is well known in the antenna art, phased array antennas include an array of radiating elements which cooperate to provide one or more output beams. Each beam is agile in that it may be steered electronically by controlling the phase relationships between each radiating element in the array.

A phased array antenna may include hundreds or thousands of radiating elements. It is readily appreciated, then, that the provision of an analog phase shifter for each element of the array is costly and adds to the weight of the antenna. The weight of the antenna is critical in certain, e.g., spacecraft, applications. Accordingly, array antennas have been developed in which the phase shifting of the transmitted or received signal is implemented digitally.

While digital phased array antennas have provided significant cost improvements for conventional phased array antennas, significant costs remain which are associated with other components of the conventional phased array antenna. For example, a conventional phased array antenna also, typically, includes a horn, an amplifier and filter and feed for each radiating element in the array. A particularly significant component of the costs associated with conventional phased array antennas is the need to provide an electrical connection between each radiating element and the amplifiers and other associated electrical components.

Thus, a need remains in the art to reduce the costs associated with the manufacture and use of phased array antennas.

SUMMARY OF THE INVENTION

The need in the art to provide a lightweight and low profile phased array antenna design with reduced costs is addressed by the phased array antenna of the present invention. The phased array antenna of the present invention includes an electromagnetically coupled integrated subarray in a multilayer structure with no vertical electrical connections and no phase shifters.

The integrated subarray includes a first layer including one or more patches of electrically conductive material. A second layer, is provided, in parallel registration with the first layer, which includes one or more resonators. Each resonator is electromagnetically coupled to a corresponding patch in the first layer. A third layer is provided which is in parallel registration with the second layer. The third layer is electromagnetically coupled to the second layer.

In a specific embodiment, the invention includes electromagnetic couplers in the second and third layers for coupling energy received by a resonator in the second layer, from a patch in the first layer, to circuitry in the third layer.

BRIEF DESCRIPTION OF THE DRAWINGS

FIG. 4 is an expanded view of a single patch over a corresponding resonator.

DESCRIPTION OF THE INVENTION

Figure 1:
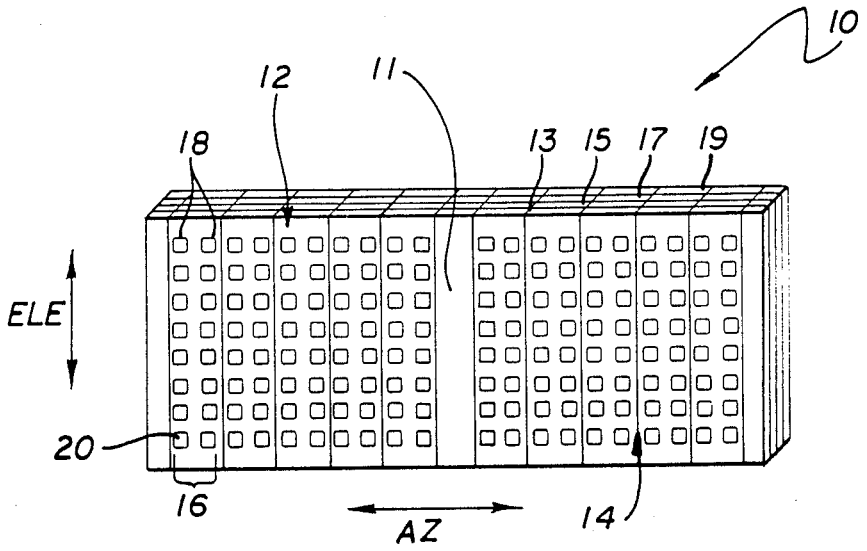
FIG. 1 is a perspective view of an illustrative embodiment of a phased array antenna constructed in accordance with the teachings of the present invention.
Figure 2:
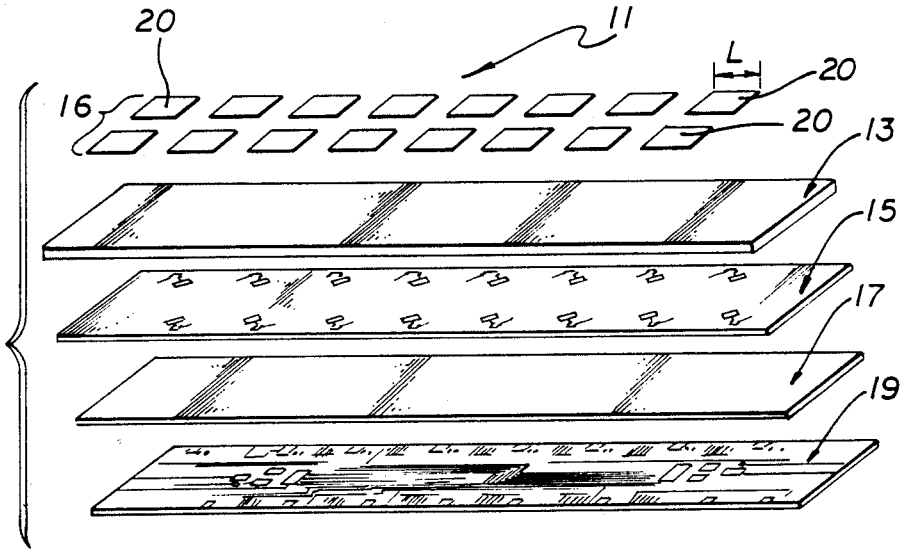
FIG. 2 shows a perspective disassembled view of a portion of the antenna 10 of the present invention.

A perspective view of an illustrative embodiment of a phased array antenna 10 constructed in accordance with the teachings of the present invention is shown in FIG. 1. FIG. 2 shows a perspective disassembled view of a portion of the antenna 10 of the present invention. As shown in FIG. 2, the antenna 10 includes a layer of patches 11 deposited on a first dielectric layer 13. A layer 15 of coplanar waveguide resonators is sandwiched between the first dielectric layer 13 and a second dielectric layer 17. The second dielectric layer 17 is, in turn, sandwiched between the layer 15 of resonators and a microstrip ground plane layer 19 including a Butler matrix feed network and active devices as is discussed more fully below. Each of the layers are in parallel registration relative to one another.

First and second 8 by 10 arrays 12 and 14 of square or rectangular patches 20 are deposited on the first dielectric layer 13. The first and second arrays 12 and 14 provide receive and transmit arrays, for example, respectively. Each array 12 and 14 includes a plurality of modules 16. Each module 16 includes two subarrays 18 of microstrip patch radiating elements 20. The patches 20 are etched from a layer of copper or other suitably conductive material.

As is known in the art, the length "L" of each patch 20 is a function of the wavelength at the operating frequency of the antenna and the dielectric constant of the substrate 13 as given by equation [1] below:

$$L \approx 0.5\lambda_d = 0.5\ \lambda o/(\epsilon r)^{\frac{1}{2}} \quad [1]$$

where

L = length of patch, $\epsilon_r$ = relative dielectric constant, $\lambda_o$ = free-space wavelength and $\lambda_d$ = dielectric substrate wavelength.

The dielectric constant $\epsilon_r$ is generally provided by the manufacturer.

The bandwidth of the energy radiated by each patch 20 is related to the operating frequency and the thickness of the substrate 13 as given by equation [2] below (from "Antenna Engineering Handbook"; 2nd edition 1984, by R. C. Johnson and H. Jasik):

$$4f^2\ d/(1/32)\ BW = 4f^2\ d/(1/32) = 128f^2d \quad [2]$$

where

BW = bandwidth in megahertz for VSWR less than 2:1;

f = the operating frequency in gigahertz; and d = the thickness of substrate 13 in inches.

A copending application entitled FOCAL PLANE ARRAY ANTENNA, by M. N. Wong et al., serial no. 317,882 describes and claims an advantageous technique for coupling energy to microstrip patch radiating elements of a focal plane array antenna with no direct electrical connections thereto. The disclosed technique involves the use of a planar microstrip resonator mounted on a second surface of a dielectric board for the coupling of electromagnetic energy therethrough to the microstrip patch element. The patch reradiates the energy, thus coupled thereto, into free space. This technique is incorporated into the phased array antenna with integrated subarray of the present invention.

That is, a plurality of resonators 22 are etched in the resonator layer 15 in one-to-one correspondence with the patch elements 20. As described more fully below, the patch elements 20 are electromagnetically coupled to the microstrip circuit layer 19 by coplanar waveguide resonators etched in the resonator ground plane layer 15. The resonator ground plane layer 15 is disposed on the side of the first dielectric layer opposite to the array of patch elements. (The first dielectric layer 13 is preferably made of Duroid or any other suitable material having a low dielectric constant $\epsilon$.) Each resonator 22 is etched in the resonator ground plane layer 15 using conventional processes.

Figures 3A, 3B, 3C:
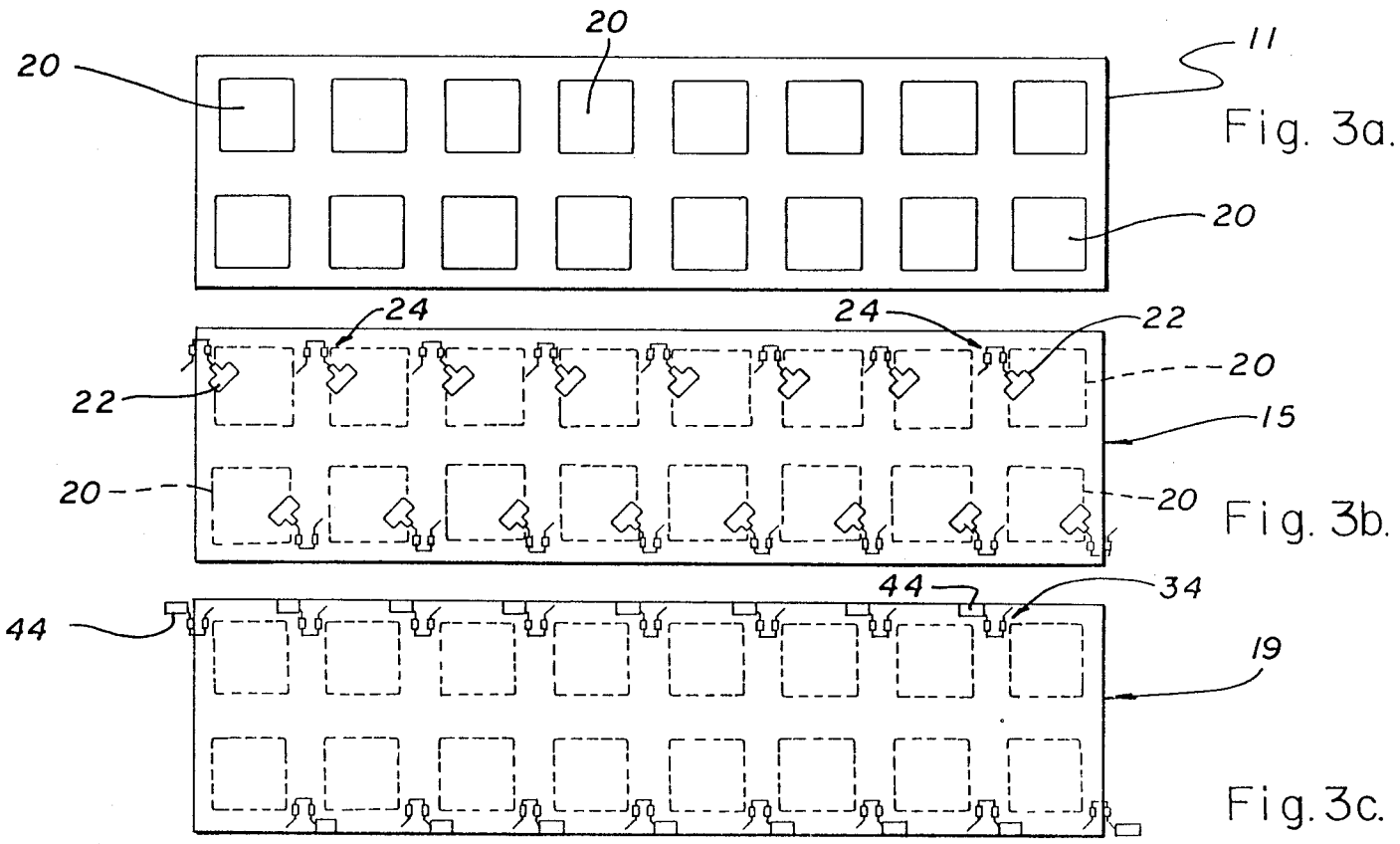
FIGS. 3(*a*), 3(*b*), and 3(*c*) shows top plan views of the patch layer, the resonator layer, and the feed network layer 19 in side-by-side relation to illustrate, inter alia, the projection of each patch over a corresponding resonator.

FIGS. 3(*a*), 3(*b*), and 3(*c*) shows top plan views of the patch layer 11, the resonator layer 15 and the feed network layer 19 side-by-side to illustrate, inter alia, the projection of each patch 20 over a corresponding resonator 22. Note, that as described in the above mentioned copending application, the orientation of each resonator 22 relative to a corresponding patch 20 at a 45 degree angle is effective to cause the patch 20 to radiate circularly polarized energy. FIG. 4 is an expanded view of a single patch over a corresponding resonator 22. The resonator is essentially a loop antenna etched in a conductive coating on the ground plane layer 15. The resonator 22 is electrically connected to a dual coupler 24 including first and second electromagnetic 3db couplers 26 and 28. The first and second 3db couplers are interconnected via an impedance matching device or connector 30. The second 3db coupler 28 is connected to a load 32.

As described in a second copending application entitled PLURAL LAYER COUPLING SYSTEM, filed by S. S. Shapiro et al., on Oct. 11, 1988, bearing serial no. 255,218, each of the first and second 3 db couplers 26 and 28 couple substantially 100% of the energy received by the resonator 22 to a corresponding matching dual coupler 34 of a plurality of dual couplers provided in the microstrip ground plane layer 19. Each dual coupler 34 has first and second 3db couplers 36 and 38, to which energy from the first and second couplers 26 and 28, respectively, of a corresponding first dual coupler 24 couple energy capacitively through the second dielectric layer 17 (not shown in FIG. 4). (The second dielectric layer 17 is preferably made of a material having a high dielectric constant $\epsilon$.)

The first and second 3db couplers 36 and 38 of the second dual coupler 34 are connected by an impedance matching device or connector 40. The first 3db coupler 36 is connected to a load 42. The second 3db coupler of the second dual coupler 34 is connected to a low noise amplifier 44.

Figure 5:
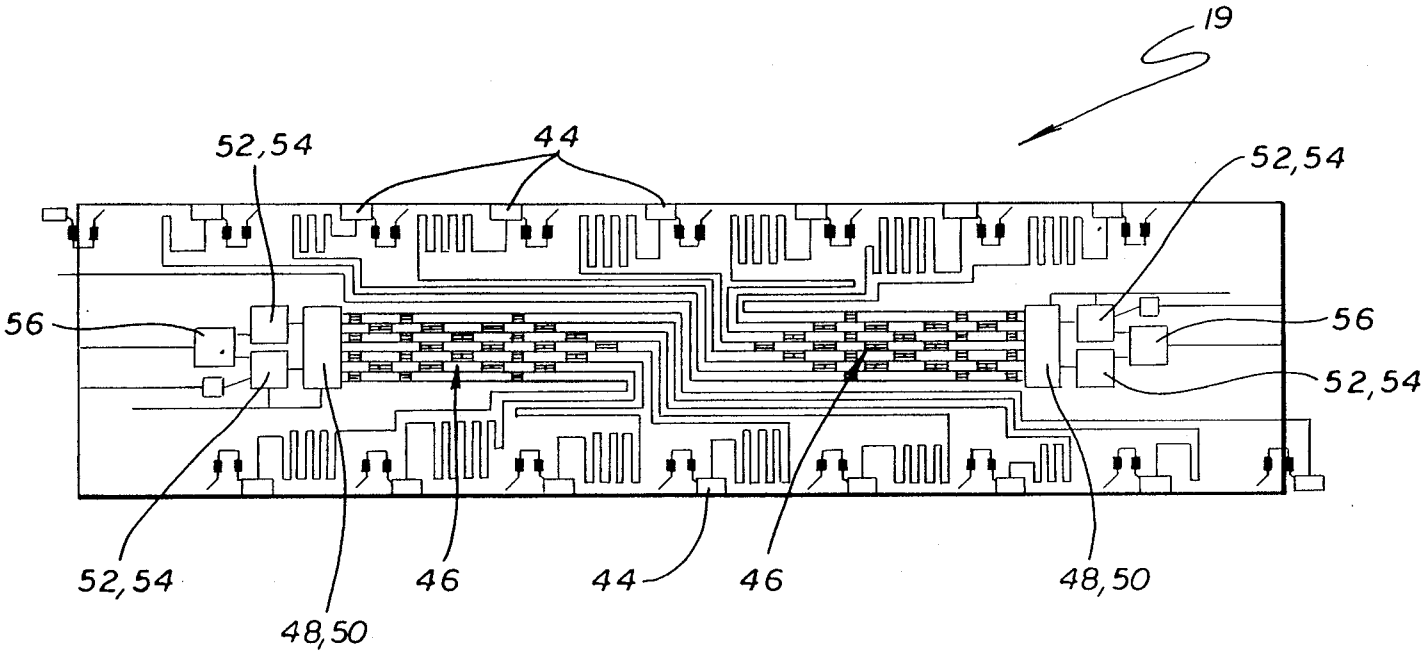
FIG. 5 shows a top plan view of an illustrative implementation of the microstrip circuit plane layer 19.

FIG. 5 shows a top plan view of an illustrative implementation of the microstrip ground plane layer 19 for the receiver subarray 12. (The receive and transmit subarrays 12 and 14 are identical except for the corresponding components in the microstrip layer 19.) A printed circuit is etched in the microstrip layer 19 which includes a low noise amplifier 44 for each patch element 20. (See, also, FIGS. 3(*a*), 3(*b*), 3(*c*) and 4.) Each low noise amplifier 44 is connected to a Butler matrix 46. In the preferred embodiment, the Butler matrix 46 is constructed in a single plane, however, the best mode of practicing the invention is not limited thereto. Multiplane Butler matrices may be used without departing from the scope of the best mode of practicing the present invention. (The microstrip circuit layer for the transmit subarray 14 has a similar layout with the exception that the transmit circuit includes solid state power amplifiers (SSPAs) which are electromagnetically coupled to the patch elements 20 through the ground plane layer resonators 22.)

One Butler matrix 46 is provided for each subarray 18 of each module 16. Two Butler matrices are shown in FIG. 5, one corresponding to each subarray 18 of a typical module 16. Each Butler matrix 46 is connected to a switch matrix 48 with an associated controller 50. The outputs of the switch matrices are connected to downconverters 52 and analog-to-digital converters (A/D) 54. The A/D converters 54 are connected to conventional digital beamforming networks 56.

Figure 6A:
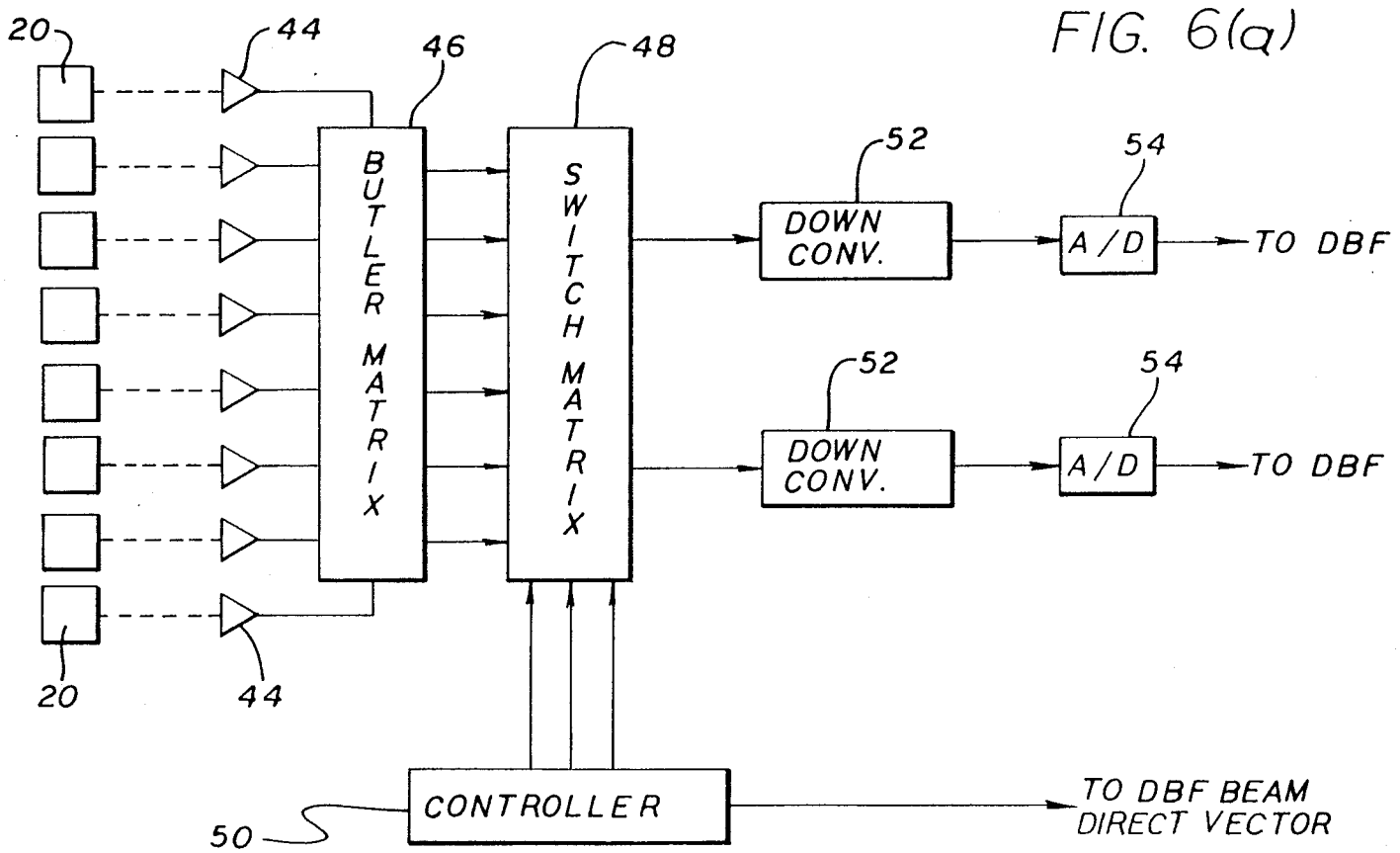
FIGS. 6(*a*) and 6(*b*) provide schematic diagrams of the antenna beam processor of the illustrative embodiment.

FIGS. 6(*a*) and 6(*b*) provide schematic diagrams of the processing circuitry of the multibeam antenna 10 of the illustrative embodiment. In the illustrative receive mode of operation, the array 12 of patch elements 20 receive electromagnetic energy which is coupled to the low noise amplifiers 44 via the resonators 22 and matching dual couplers 24 and 34. The amplified received signals corresponding to a single subarray 18 are Fourier transformed by the Butler matrix 46. That is, the Butler matrix 46 serves as a spatial Fourier transformer, converting the element space information into beam space information and dividing the elevation space into, approximately, eight (elevation) sectors, if the subarray 18 is vertically aligned as shown in FIG. 1. Thus, the Butler matrix 46 provides one output for each input to the switch matrix 48. In the illustrative embodiment of FIG. 1, eight patch elements are provided in each subarray 18.

Figure 7:
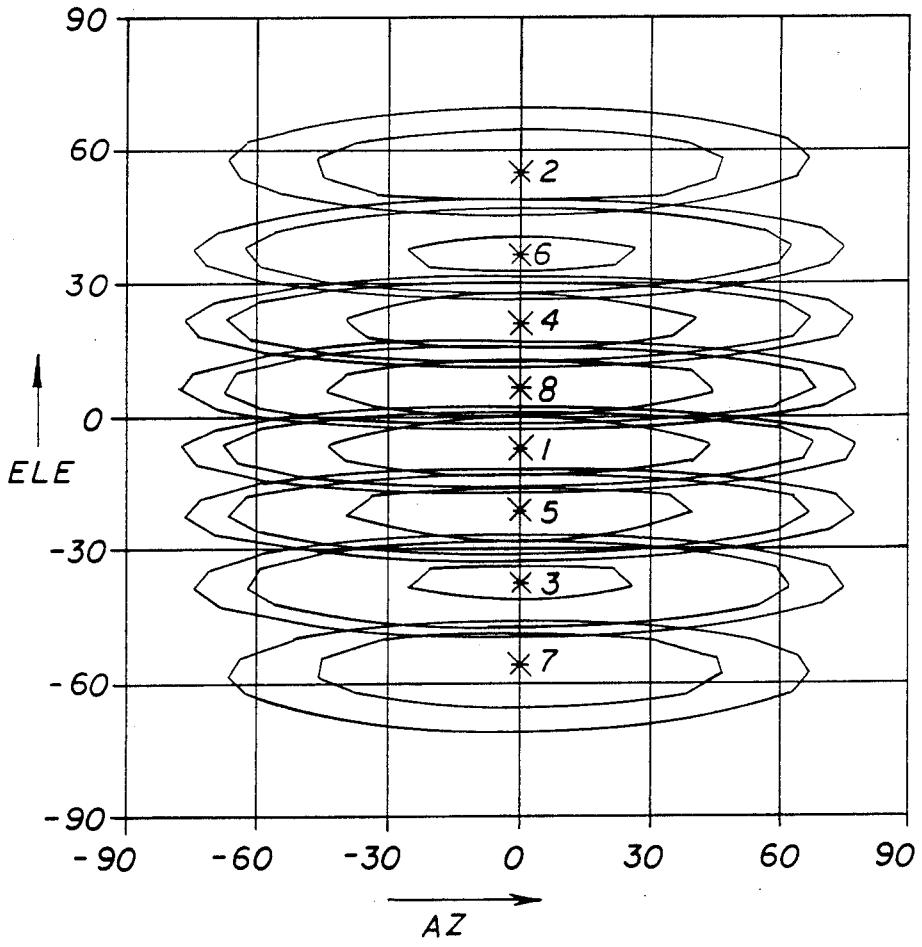
FIG. 7 is a graphical representation of the antenna beam pattern of the phased array antenna of the present invention showing the contiguous fanbeams of the Butler matrix of the illustrative embodiment.
Figure 8:
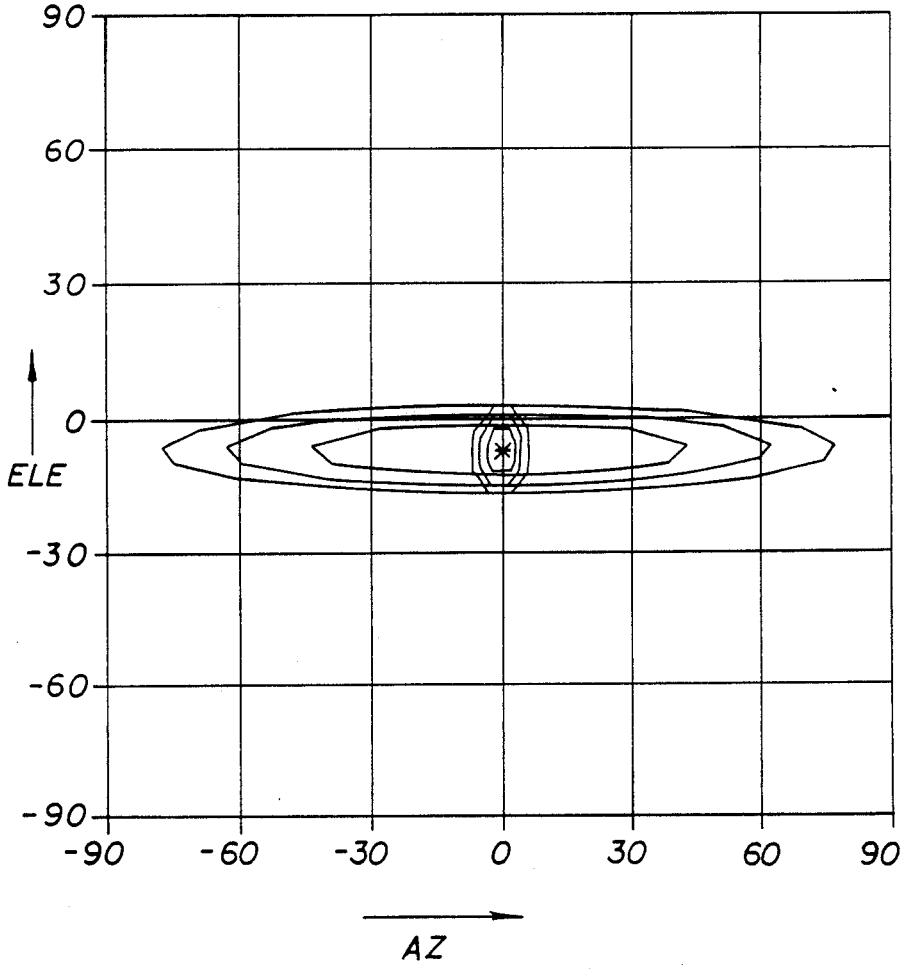
FIG. 8 is a graphical representation of the antenna beam pattern of the phased array antenna of the present invention showing a single fanbeam selected for further processing by the controller and switch matrix of the illustrative embodiment.
Figure 9:
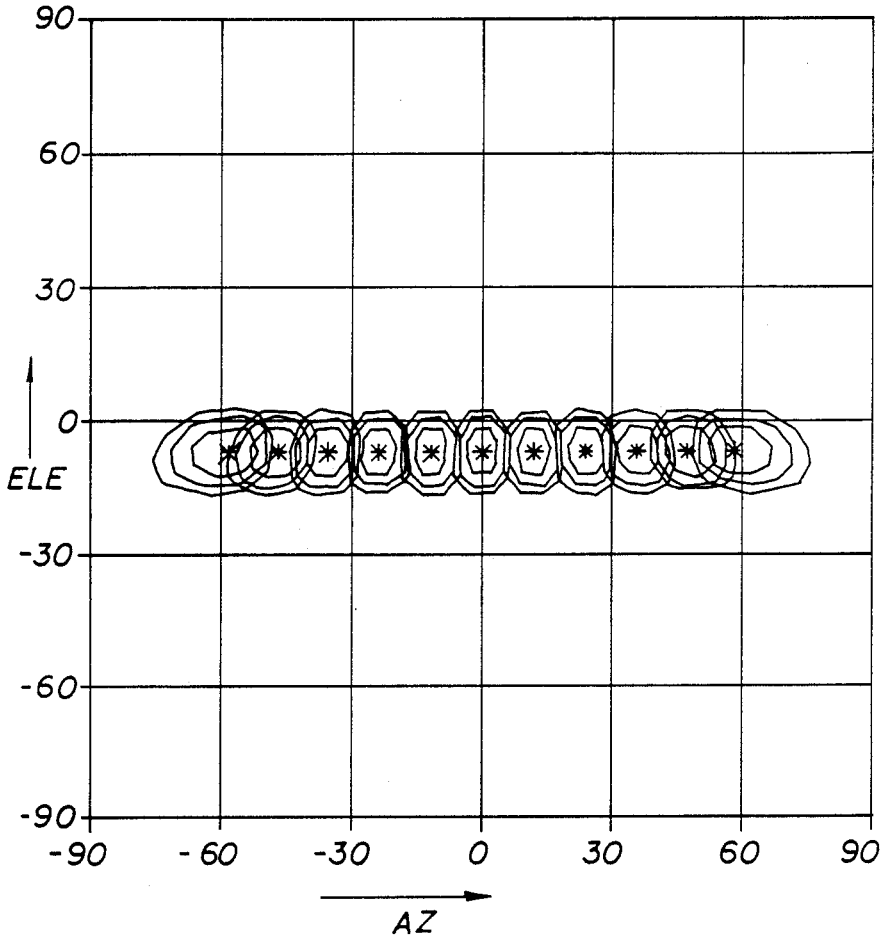
FIG. 9 is a graphical representation of the antenna beam pattern of the phased array antenna of the present invention showing the multiple spot beams which may be simultaneously generated by the digital beam former of the illustrative embodiment.

Accordingly, the Butler matrix 46 is an 8-to-8 one dimensional Butler matrix, the outputs of which correspond to eight contiguous fanbeams as shown in FIG. 7. The ordinate of FIG. 7 corresponds to elevation (length up and down a subarray) and represents the amplitude of the transformed signal. The abscissa corresponds to the coverage in azimuth of each patch element 20. The switch matrix 48 operates under control of the controller 50 to select the desired elevation sector for further processing. This is illustrated in FIG. 8 which shows a fanbeam selected for further processing by the controller 50 via the switch matrix 48. Within each elevation sector, the outputs of the switch matrices are downconverted, sampled and digitized by the downconverters 52 and A/D converters 54. The digital beamforming network (DBFN) 56 will then combine the digitized signals originated from the 10 Butler matrices 46 of the receive array 12 to form a spot beam which may scan in any direction within the fanbeam or multiple simultaneous spot beams, as illustrated in FIG. 9, in a conventional manner known to those skilled in the art.

FIG. 6(*b*) shows a simplified illustrative implementation of the DBFN 56. The DBFN includes a plurality of digital multipliers 58 which receive input from an A/D converter 54. Each multiplier 58 multiplies the digital stream representing the input signal with a signal of the form $e^{jn\Delta\phi 1}$, where n goes from 1 to N and N equals the number of patch elements in a subarray (8 in the illustrative embodiment), $\Delta$ is a phase differential or gradient between elements and can be up to $\pm\pi$ radians. The output of each multiplier 58 is input to a summer 60. Thus, the output of the summer 60 is the signal from a given direction which is specified by the beam directional vector which is of the form:

$$W_1 = (e^{j\Delta\phi 1}, e^{j2\Delta\phi 1}, \ldots e^{j\,10\,\Delta\phi 1}) \qquad [3]$$

In short, the output Y is a weighted sum of the inputs X:

$$Y = W_1 \cdot X^T \qquad [4]$$

Thus, the present invention has been described herein with reference to a particular embodiment for a particular application. Those having ordinary skill in the art and access to the present teachings will recognize additional modifications, applications and embodiments within the scope thereof. For example, the invention is not limited to a particular technique for electromagnetically coupling energy from a patch element to the microstrip layer and vice versa. The implementation of the illustrative embodiment of the present invention allows microstrip circuit layers to be fabricated using high volume low cost printed circuit techniques. Assembly of the subarray is accomplished by simply aligning and stacking the printed circuit layers. This would further reduce the cost of the subarray.

Further, the invention is not limited to the generation of a single spot beam. In an exemplary alternative search mode, the switches on the switch matrix may be set by the controller 50 to select two identical fanbeams from all (e.g. ten) subarrays. This would result in two independent spot beams being formed separately, one within each elevation sector. This would provide additional redundancy during normal single beam operation.

It is therefore intended by the appended claims to cover any and all such applications, modifications and embodiments within the scope of the present invention.

Accordingly,

What is claimed is:

1. An antenna, including:

a first layer of dielectric material having first and second opposite planar surfaces, said first layer of dielectric material including one or more patches of electrically conductive material provided on said first planar surface thereof;

a second layer of dielectric material having first and second opposite planar surfaces;

a first ground plane layer interposed between said first and second layers of dielectric material, said first ground plane layer having first and second opposite planar surfaces disposed in abutting relation with said second planar surface of said first layer of dielectric material and said first planar surface of said second layer of dielectric material, respectively, said first ground plane layer including one or more co-planar waveguide resonators provided on said first planar surface thereof, wherein said patches and said resonators are disposed in electromagnetically coupled relation to each other;

a second ground plane layer having first and second opposite planar surfaces, said first planar surface of said second ground plane layer being disposed in abutting relation with said second planar surface of said second layer of dielectric material, said second ground plane layer including signal handling circuitry provided on said first planar surface thereof, wherein said resonators and said signal handling circuitry are disposed in electromagnetically coupled relation to each other; and, wherein said first dielectric layer has a relatively low dielectric constant and said second dielectric layer has a relatively high dielectric constant, and the above-cited layers are arranged in a stacked configuration.

2. The antenna as set forth in claim 1, wherein said resonators each comprise a loop antenna etched into said first planar surface of said first ground plane layer.

3. The antenna as set forth in claim 1, wherein said signal handling circuitry includes an antenna feed network.

4. The antenna as set forth in claim 3, wherein said signal handling circuitry further includes a digital beam forming network electrically coupled to said antenna feed network.

5. The antenna as set forth in claim 3, wherein said antenna feed network includes a Butler matrix feed network.

6. The antenna as set forth in claim 3, further including one or more first electromagnetic couplers provided on said first planar surface of said first ground plane layer, with said first electromagnetic couplers being electrically connected to corresponding ones of said resonators, one a one-to-one basis.

7. The antenna as set forth in claim 6, wherein said signal handling circuitry further includes one or more second electromagnetic couplers electromagnetically coupled, on one-to-one basis, with corresponding ones of said first electromagnetic couplers, and electrically connected to said antenna feed network.

8. The as set forth in claim 6, wherein said signal handling circuitry further includes one or more low noise amplifiers electrically interconnected, on a one-to-one basis, between said second electromagnetic couplers and said antenna feed network.

9. The antenna as set forth in claim 8, wherein said signal handling circuitry further includes a switch matrix electrically connected to said antenna feed network.

10. The antenna a set forth in claim 9, wherein said signal handling circuitry further includes one or more downconverters electrically connected to said switch matrix.

11. The antenna as set forth in claim 10, wherein said signal handling circuitry further includes one or more analog-to-digital converters electrically connected, on a one-to-one basis, to corresponding ones of said downconverters.

12. The antenna as set forth in claim 11, wherein said signal handling circuitry further includes a digital beam forming network electrically connected to each of said analog-to-digital converters.

13. The antenna as set forth in claim 7, wherein said signal handling circuitry comprises microstrip circuitry etched into said first planar surface of said second ground plane layer.

14. The antenna as set forth in claim 12, wherein said signal handling circuitry comprises a printed circuit etched into said first planar surface of said second ground plane layer.

15. The antenna as set forth in claim 7, wherein said first and second electromagnetic couplers each comprise dual 3dB couplers.

* * * * *